US008978338B2

(12) United States Patent
Jobin et al.

(10) Patent No.: US 8,978,338 B2
(45) Date of Patent: Mar. 17, 2015

(54) STRUCTURAL TRUSSES WITH MONOLITHIC CONNECTOR PLATE MEMBERS

(71) Applicant: Les Enceintes Acoustiques Unisson Inc., Saint-Roch-de-l'Achigan (CA)

(72) Inventors: Pierre Jobin, Laval (CA); Jean-Francois Ducharme, Montreal (CA)

(73) Assignee: Les Enceintes Acoustiques Unisson Inc., Saint-Roch-de-l'Achigan, Quebec (CA)

( * ) Notice: Subject to any disclaimer, the term of this patent is extended or adjusted under 35 U.S.C. 154(b) by 0 days.

(21) Appl. No.: 13/886,253

(22) Filed: May 2, 2013

(65) Prior Publication Data

US 2013/0291477 A1 Nov. 7, 2013

Related U.S. Application Data

(60) Provisional application No. 61/641,604, filed on May 2, 2012.

(51) Int. Cl.

| | |
|---|---|
| ***E04H 12/00*** | (2006.01) |
| ***E04C 3/02*** | (2006.01) |
| ***E04C 3/08*** | (2006.01) |
| *E04C 3/04* | (2006.01) |
| *E04B 1/24* | (2006.01) |

(52) U.S. Cl.

CPC ... *E04C 3/02* (2013.01); *E04C 3/08* (2013.01); *E04C 2003/0495* (2013.01); *E04B 2001/2406* (2013.01); *E04B 2001/2472* (2013.01)

USPC ..... 52/653.2; 52/650.2

(58) Field of Classification Search

USPC ..... 52/653.2, 650.2, 650.1, 655.1, 633

See application file for complete search history.

(56) References Cited

U.S. PATENT DOCUMENTS

| | | | | |
|---|---|---|---|---|
| 2,936,051 | A * | 5/1960 | Martin | 52/694 |
| 5,205,101 | A | 4/1993 | Swan et al. | |
| 5,390,463 | A | 2/1995 | Sollner | |
| 5,964,068 | A | 10/1999 | O'Neil | |
| 6,082,068 | A * | 7/2000 | Fisher | 52/633 |
| 6,145,269 | A * | 11/2000 | Fisher | 52/637 |
| 7,654,059 | B2 | 2/2010 | Hejnicki | |

FOREIGN PATENT DOCUMENTS

WO 2011/097409 A1 8/2011

* cited by examiner

*Primary Examiner* — Basil Katcheves

(74) *Attorney, Agent, or Firm* — IPAXIO S.E.N.C.

(57) ABSTRACT

The structural truss includes a connector plate member welded to the framework between two corresponding longitudinal tubes. The connector plate member is made of a monolithic piece. It includes a corner beam section protruding from the rear side of the connector plate member and a main plate section extending perpendicularly inwards on a side of the corner beam section. The main plate section and the corner beam section define together a planar outer abutment plate surface. The connector plate member also includes a lip projecting at right angle from the main plate section on the rear side of the connector plate member. The lip extends substantially parallel to the corner beam section.

5 Claims, 16 Drawing Sheets

STRUCTURAL TRUSSES WITH MONOLITHIC CONNECTOR PLATE MEMBERS

CROSS-REFERENCE TO RELATED APPLICATION

The present case claims the benefit of U.S. Patent Application No. 61/641,604 filed on 2 May 2012, which application is hereby incorporated by reference in its entirety.

TECHNICAL FIELD

The technical field relates generally to structural trusses for supporting loads.

BACKGROUND

Structural trusses are very useful in a wide variety of situations. They can be used vertically, horizontally or in any other possible orientation. They generally include an elongated framework having three or more spaced-apart tubes extending in the lengthwise direction. The longitudinal tubes are rigidly interconnected to one another using a network of intervening members.

In most implementations, at least one end of each structural truss needs to be connected to an adjacent element in a construction assembly. The adjacent element can be a supporting structure or another structural truss. For instance, two adjacent structural trusses can be connected directly end-to-end or through another element. Various factors can impose limitations to the length of a structural truss and, for instance, it may be required and/or more desirable to attach two or more smaller structural trusses instead of using a single but longer structural truss. A very long structural truss can create complications in terms of handling and transportation, for example. Using smaller lengths of structural trusses assembled together is generally desirable.

In use, bending moment in a structural truss set at the horizontal is carried by tension or compression in the chords and the shear force is carried by the diagonals. The purpose of a connection is to transfer the bending moment and shear force from one structural truss or module to the next. The connection must also be stable.

Connecting one end of a structural truss to an adjacent element create some challenges, especially when welding is involved. The known connector arrangements have used parts such as small plates or gussets welded to the end face of the framework so as to provide a supporting interface for fasteners, in particular removable fasteners such as sets of bolts, nuts and washers. The welding process typically creates heat affected zones. These zones are generally extending up to one inch from the weld beads. The metal in the heat affected zones is more ductile than before the welding and the allowable stress in the heat affected zones is reduced by a substantial factor. Using larger tubes and/or plates can compensate for the heat affected zones but this adds weight and costs. It also reduces the space available for the fasteners. The fasteners must be located as close as possible to the corners of the structural truss to increase strength.

FIG. 22 illustrates an example of a structural truss 500 as found in the prior art. This structural truss 500 has end plates 502 welded to four interconnected tubes forming the end of the framework 504. The end plates 502 include holes made through their thickness to receive the shank of the connecting bolts. When connecting two of these structural trusses 500 together, the head of the bolts will be on the inner side of the end plates 502 of one structural truss 500, and the opposite nuts will be on the inner side of the end plates 502 of the other structural truss. Annular washers are provided between the head of the bolts and the back side surface of the end plates to distribute the forces on a wider area. Annular washers are also used between the nuts and the back side surface of the opposite end plates 502 for the same reasons. Moreover, since the end frame is also welded onto the framework, this part of the structural truss also includes heat affected zones.

The typical route which the retaining forces in such arrangement is as follows:

chord—weld—end frame—weld—end plate—washer—bolt—nut—washer—end plate—weld—end frame—weld—chord.

The bolts, nuts and/or washers transmit the load into the end plates 502, which induce a considerable amount of local stress and deformation. Since the distance between the neutral axis of the bolt and the chords are distanced depending of the industry standard of holes position, it is often not possible to use oversized washers in order to distribute the load on a wider area in order to lower the mechanical stress on the end plates 502 around the holes. This can significantly reduce the end plate capacity. The use of larger tubes at the end frame to compensate for the head affected zones can force designers to move the fastener holes further away from the corners, which again can reduce the load bearing capacity.

Clearly, room for improvements exists in this area.

SUMMARY

In one aspect, there is provided a structural truss having a tubular framework with opposing ends and that extends lengthwise along a main longitudinal axis, at least one of the opposing ends of the structural truss including at least one connector plate member welded to the framework between two corresponding longitudinal tubes, the connector plate member being made of a monolithic piece having an outer side and a rear side, the connector plate member including: a corner beam section extending between the two corresponding longitudinal tubes, the corner beam section protruding from the rear side of the connector plate member, the corner beam section including two opposite ends, each having a corresponding first cutout configured and disposed to fit around an end of the corresponding longitudinal tubes; a main plate section extending perpendicularly inwards on a side of the corner beam section and in a direction that is substantially perpendicular to the longitudinal axis, the main plate section including at least one fastener hole to receive a mounting bolt, the main plate section and the corner beam section defining together a planar outer abutment plate surface; and a lip projecting at right angle from the main plate section on the rear side of the connector plate member, the lip extending substantially parallel to the corner beam section.

In another aspect, there is provided a connector plate member for use with a structural truss, the connector plate member being made of a monolithic piece having an outer side and a rear side, the connector plate member including: an elongated corner beam section extending between the two corresponding longitudinal tubes, the corner beam section including two opposite ends, each having a corresponding first cutout;

a main plate section extending perpendicularly on a side of the corner beam section, the main plate section including at least one fastener hole to receive a mounting bolt, the main plate section and the corner beam section defining together a planar outer abutment plate surface; and a lip projecting at right angle from the main plate section on the rear side of the connector plate member, the lip extending substantially parallel to the corner beam section.

In another aspect, there is provided a junction block connector for use with at least one structural truss, the junction block connector including two connector plate members provided at least one side of the junction block connector, each connector plate member being made of a monolithic piece having an outer side and a rear side, each connector plate member including: an elongated corner beam section extending between the two corresponding longitudinal tubes, the corner beam section including two opposite ends, each having a corresponding first cutout; a main plate section extending perpendicularly on a side of the corner beam section, the main plate section including at least one fastener hole to receive a mounting bolt, the main plate section and the corner beam section defining together a planar outer abutment plate surface; and a lip projecting at right angle from the main plate section on the rear side of the connector plate member, the lip extending substantially parallel to the corner beam section.

Further details on these aspects as well as other aspects of the proposed concept will be apparent from the following detailed description and the appended figures.

DETAILED DESCRIPTION

Figure 1:
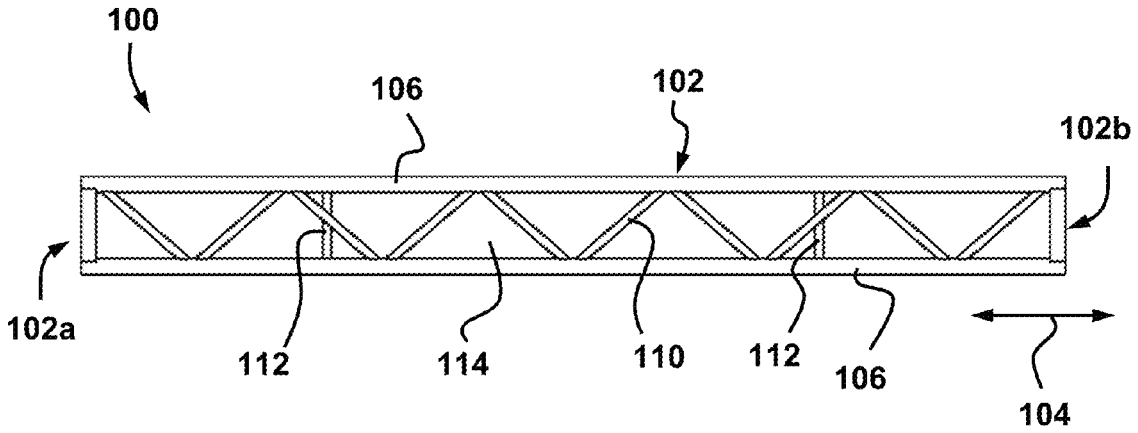
FIG. 1 is a side view of an example of a structural truss incorporating the proposed concept.

FIG. 1 is a side view of an example of a structural truss 100 incorporating the proposed concept. This structural truss 100 is suitable for a very wide variety of applications. To name just a few, this including for instance building or the like, bridges or similar structures, exhibition stages, lightning equipment or other scenic elements for live performance and events. The structural truss 100 can be used in a permanent or temporary construction.

The structural truss 100 can be made entirely of metal, although variants are possible as well. Aluminum or an alloy thereof is an example of a possible material.

The illustrated structural truss 100 has a quadrilateral tubular framework 102 with opposing ends 102*a*, 102*b*. The framework 102 extends lengthwise along a main longitudinal axis 104 and includes four spaced-apart longitudinal tubes 106 running substantially parallel to one another.

The illustrated framework 102 has a substantially rectangular cross section, with one corresponding longitudinal tube 106 for each corner of the framework 102. The illustrated framework 102 is thus a generic example and the exact configuration of the framework 102 can vary from one implementation to another. For instance, the structural truss 100 can be provided with three longitudinal tubes 106 or even more than four longitudinal tubes 106. Also, although the framework 102 is shown as being rectilinear in the lengthwise direction, the framework 102 can be arc-shaped or be otherwise curved. In such situation, the longitudinal axis 104 will thus be arc-shaped or otherwise curved as well.

The longitudinal tubes 106 can be circular in cross section, as shown, or can be rectangular in cross section, depending on the needs. Variants are possible as well.

The longitudinal tubes 106 are interconnected by a plurality of bracing members 110 that are obliquely disposed in-between the longitudinal tubes 106. The bracing members 110 are in the form of rigid tubes made of the same material as the longitudinal tubes 106, for instance aluminum or an alloy thereof. The ends of the bracing members 110 are welded or otherwise rigidly connected to the longitudinal tubes 106. The illustrated example includes two sets of bracing members 110 disposed in the vertical plane. They create a zigzag pattern in the lengthwise direction. Variants are also possible.

FIG. 1 further shows diagonal cross members 112 extending across the open space 114 located inside the structural truss 100. The diagonal cross members 112 are in the form of rigid tubes made of the same material as the longitudinal tubes 106, for instance aluminum or an alloy thereof. Variants are possible as well.

Figure 2:
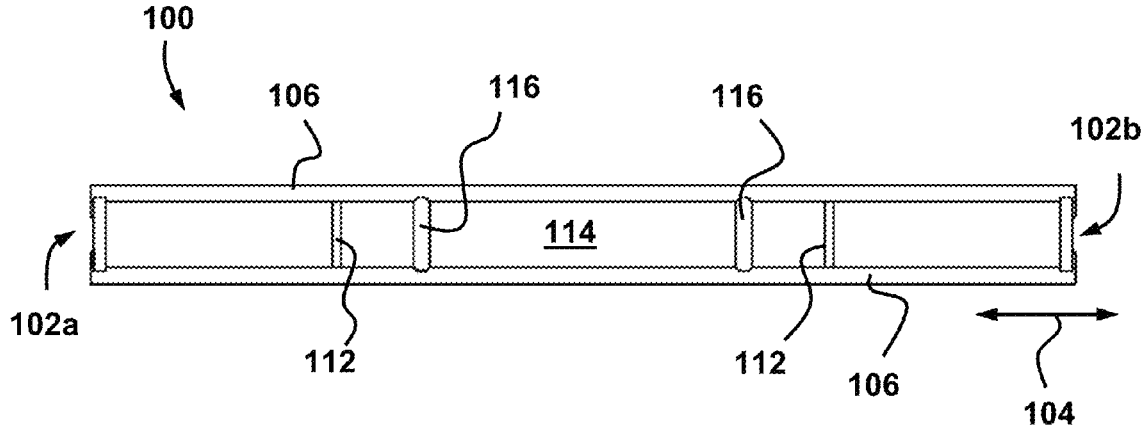
FIG. 2 is a top view of the structural truss shown in FIG. 1.

The ends of the diagonal cross members 112 are welded or otherwise rigidly attached to the corresponding longitudinal tubes 106. These diagonal cross members 112 are also visible in FIG. 2, which is a top view of the structural truss 100 shown in FIG. 1. This structural truss 100 includes a plurality of spaced-apart transversal cross members 116 extending horizontally at right angle with reference to the longitudinal axis 104 and running parallel to the top and bottom side of the framework 102. The ends of the transversal cross members 116 are welded or otherwise rigidly attached at right angle to the corresponding longitudinal tubes 106. Transversal cross members 116 are located at the opposite ends 102*a*, 102*b* of the framework 102.

If desired, one can provide additional bracing members in a zigzag pattern across the top and/or bottom side of the framework 102. Other variants are possible as well.

Figure 3:
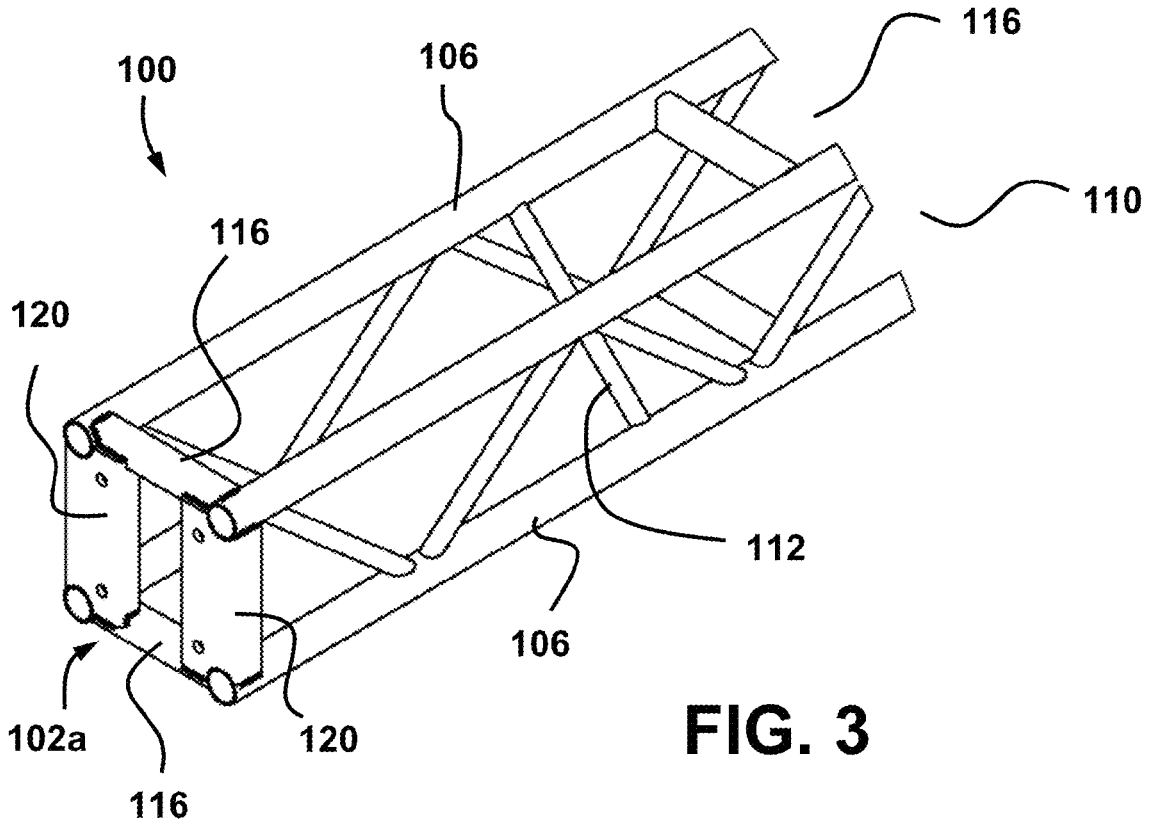
FIG. 3 is an isometric view illustrating a portion of the structural truss shown in FIG. 1.

FIG. 3 is an isometric view illustrating a portion of the structural truss 100 shown in FIG. 1, namely the portion where the end 102*a* is located. FIG. 3 shows the structural truss 100 from the top side. As can be seen, the end 102*a* of the framework 102 includes two transversal cross members 116 welded near the corresponding free ends of the longitudinal tubes 106. The transversal cross members 116 are positioned horizontally in the illustrated example. One is adjacent to the top side and the other is adjacent to the bottom side.

Also provided are two spaced-apart connector plate members 120. The ends of the connector plate members 120 are welded to the framework 102. Both connector plate members 120 extend parallel to one another between two corresponding longitudinal tubes 106. They are also symmetrically disposed. Each connector plate member 120 is made of an elongated rectilinear monolithic piece and is manufactured using a machined extruded workpiece. Each of these connector plate members 120 are integrated into the framework 102 in a way that will minimize the welding beads required for rigidly connecting them to the rest of the framework 102. This way, the assembly time will be significantly reduced and the tubes used in making the end portions of the structural truss 100 can be smaller since the heat affected zones will be minimal.

Figure 4:
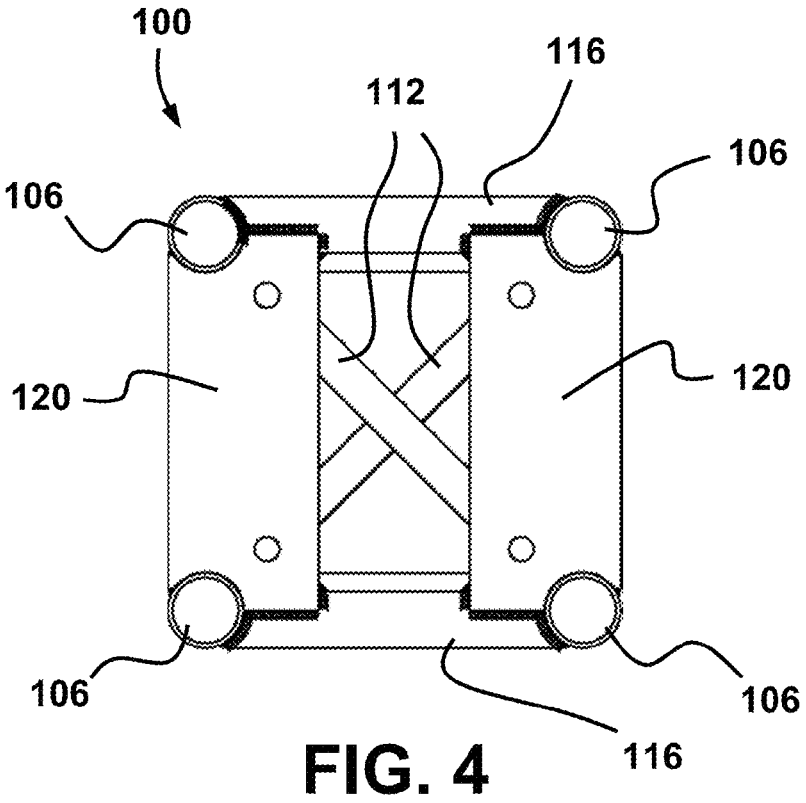
FIG. 4 is an end view of the portion of the structural truss shown in FIG. 3.
Figure 5:
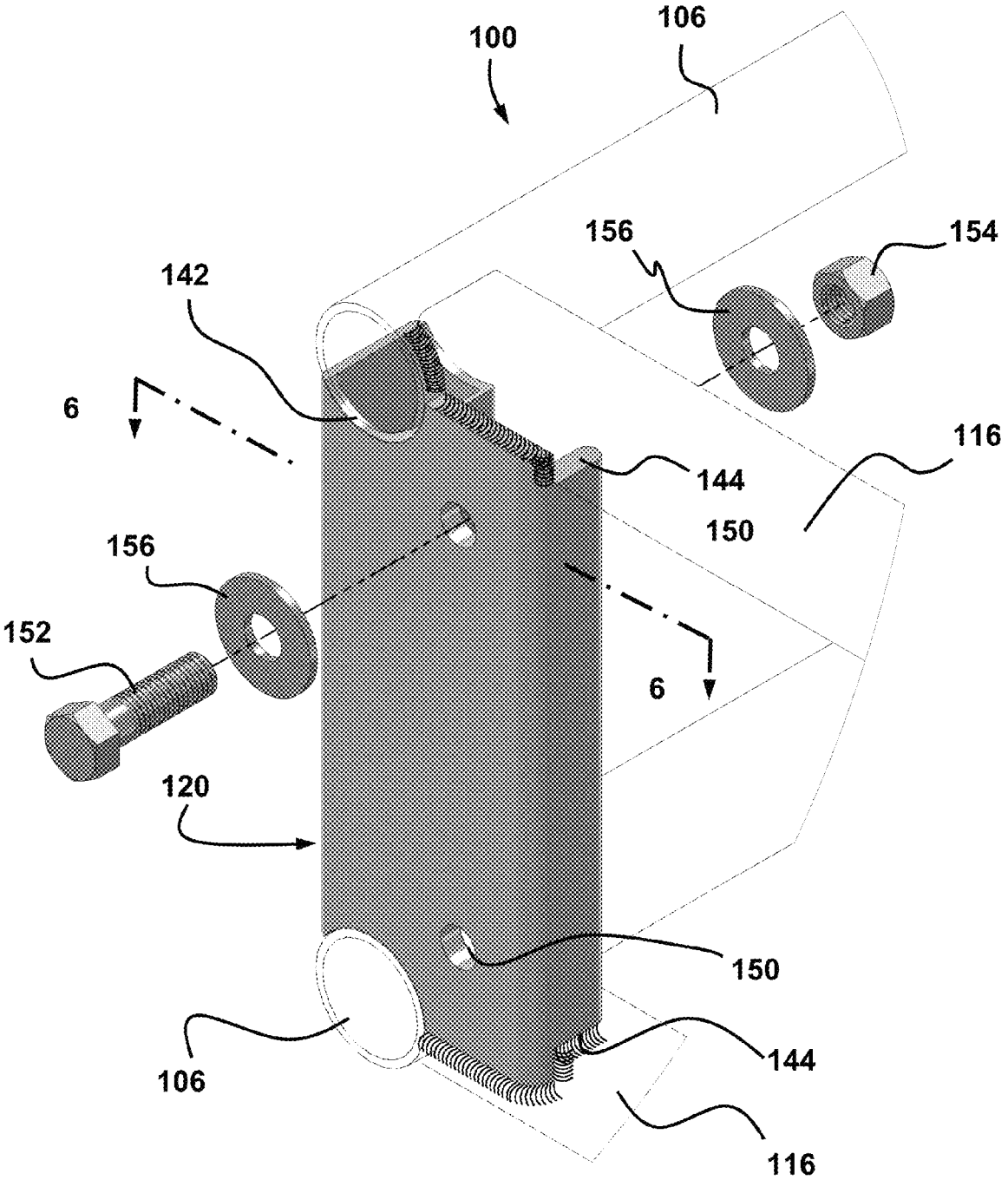
FIG. 5 is an enlarged isometric and semi-schematic view of one of the connector plate members shown in FIG. 3.

FIG. 4 is an end view of the portion of the structural truss 100 shown in FIG. 3. This figure shows that the connector plate members 120 are welded to the longitudinal tubes 106 and the transversal cross members 116 only at the opposite ends thereof. The welding beams are also visible in FIG. 5. FIG. 5 is an enlarged isometric and semi-schematic view of one of the connector plate members 120 shown in FIG. 3.

Figure 6:
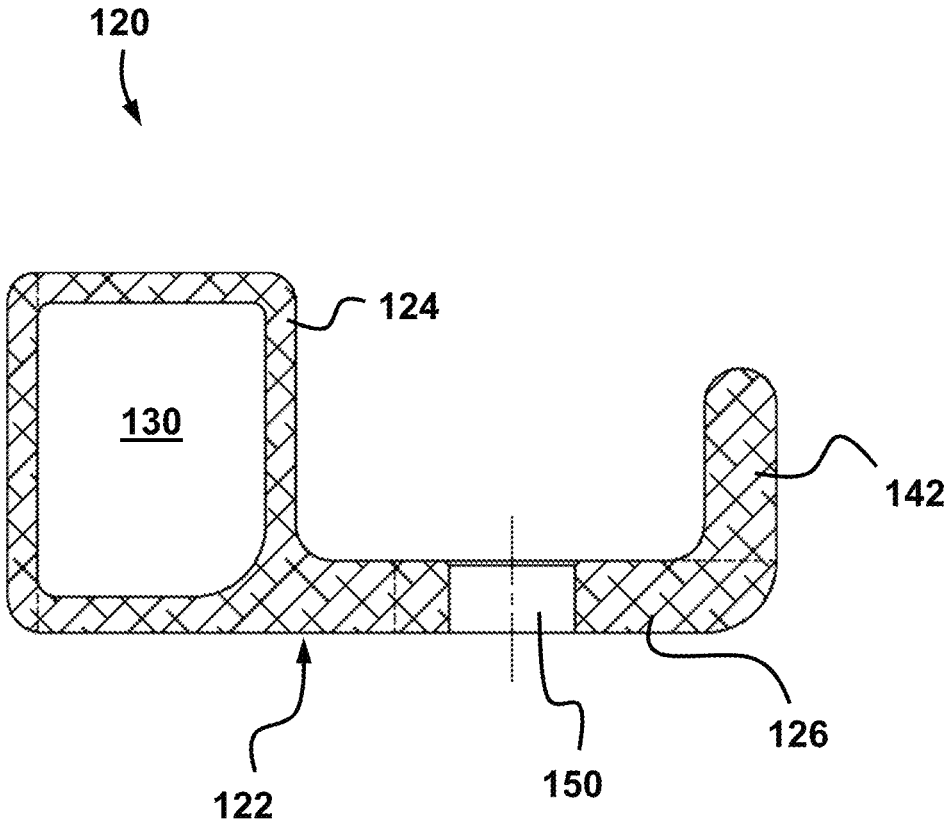
FIG. 6 is a cross section view of the connector plate member taken along line 6-6 in FIG. 5.

FIG. 6 is a cross section view of the connector plate member 120 taken along line 6-6 in FIG. 5. As can be seen, each plated connector member 120 has substantially a somewhat lowercase-a-shaped cross section.

Each connector plate member 120 includes an outer abutment plate surface 122, which surface 122 is substantially flat and uninterrupted in the illustrated example. The outer abutment plate surface 122 is part of both a corner beam section 124 and a main plate section 126.

The corner beam section 124 has a hollow interior space 130 surrounded by walls forming a rectangular cross section and having rounded edges between them. The corner beam section 124 includes two opposite ends. In the illustrated example, one end is at the top side and the other end is at the bottom side. The corner beam section 124 extends between the two corresponding longitudinal tubes 106 once the connector plate members 120 are welded to the framework 102, as shown best in FIGS. 4 and 5. The corner beam section 124 protrudes from a rear side of the connector plate member 120, which rear side is opposite the outer abutment plate surface 122.

It should be noted that the corner beam section 124 can have a different shape than that shown and described herein. For instance, it can have a rounded shape. Some implementations may omit the hollow interior space.

Each end of the corner beam section 124 has a corresponding first cutout 140 provided to fit around the free end of the corresponding longitudinal tubes 106. These first cutouts 140 can be machined on the extruded workpiece when the connector plate members 120 were manufactured.

The main plate section 126 of each connector plate member 120 extends perpendicularly on a side of the corner beam section and in a direction that is substantially parallel to the outer abutment plate surface 122. The main plate section 126 includes at least one fastener hole 150 to receive a bolt 152 (FIG. 5) when connecting the corresponding connector plate member 120 to an adjacently-disposed connector plate member 120. The number of holes 150 will depend on various factors and the implementations. Two holes 150 having a similar diameter are provided in the illustrated example. Variants are possible as well.

Each connector plate member 120 further includes a lip 142 projecting at right angle from an inner side of the main plate section 126. The lip 142 extends substantially parallel to the corner beam section 124 and is positioned at the edge of the main plate section 126 in the illustrated example. The lip 142 includes two opposite ends, each having a corresponding second cutout 144. These second cutouts 144 are configured and disposed to fit around a corresponding one of the transversal cross members 116.

Figure 7:
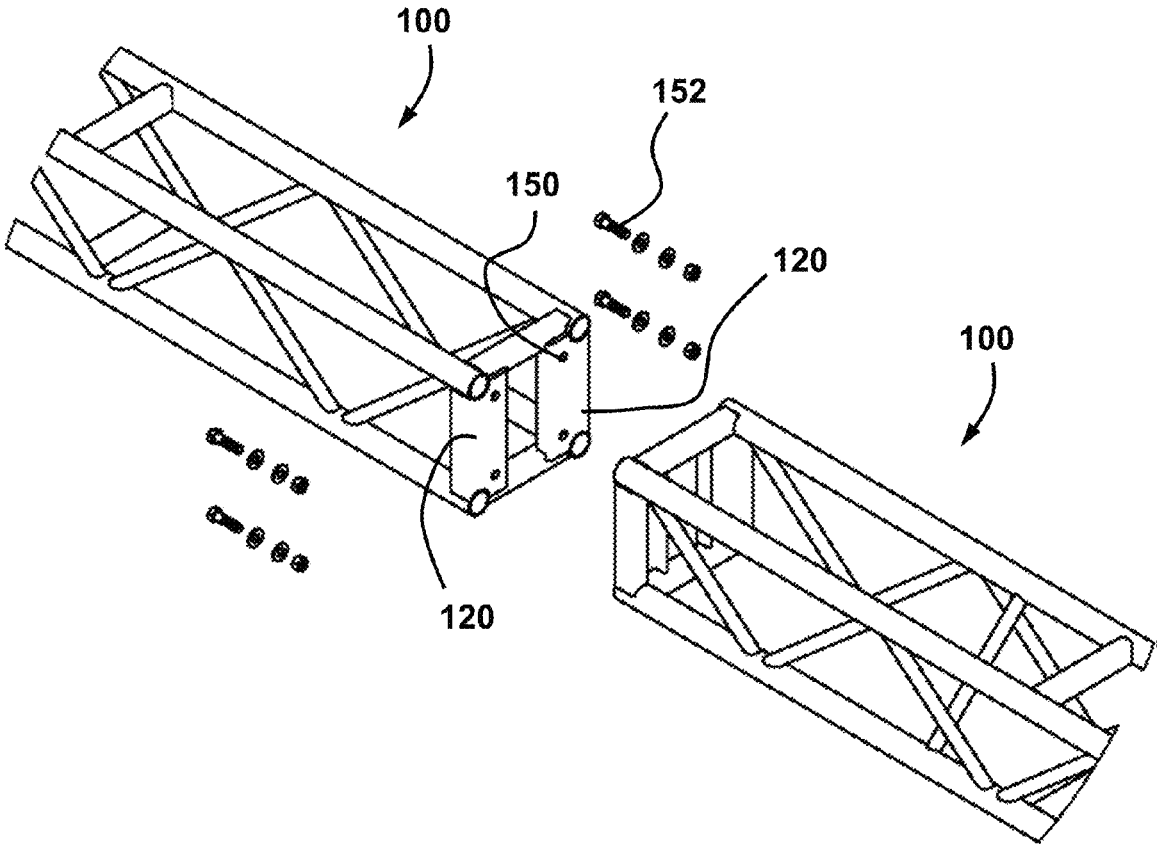
FIG. 7 is an isometric view illustrating an example of two adjacent structural trusses of FIG. 1 being adjoined end-to-end.

FIG. 7 is an isometric view illustrating an example of two adjacent structural trusses 100 of FIG. 1 being adjoined end-to-end. As can be seen, the structural trusses 100 are configured and disposed so that corresponding holes 150 on both sides of the interface will be in registry with one another to receive the bolts 152. The outer abutment plate surfaces 122 will be brought into a mating engagement and tightening the bolts 152 and nuts 154 will create a very solid connection between these two structural trusses 100.

Figure 8:
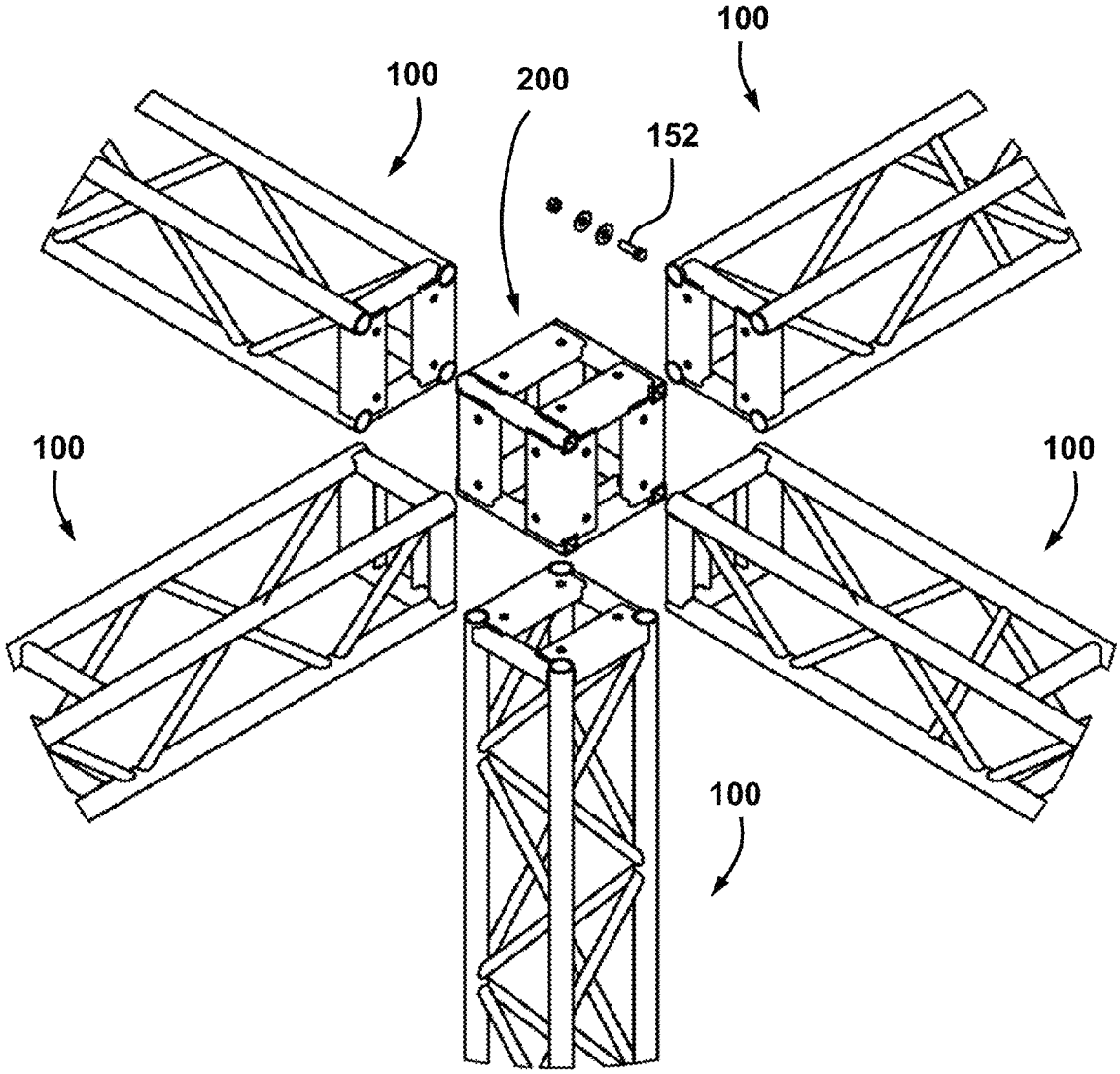
FIG. 8 is an isometric view illustrating an example of a plurality of adjacent structural trusses being connected to one another through a junction block connector.
Figure 10:
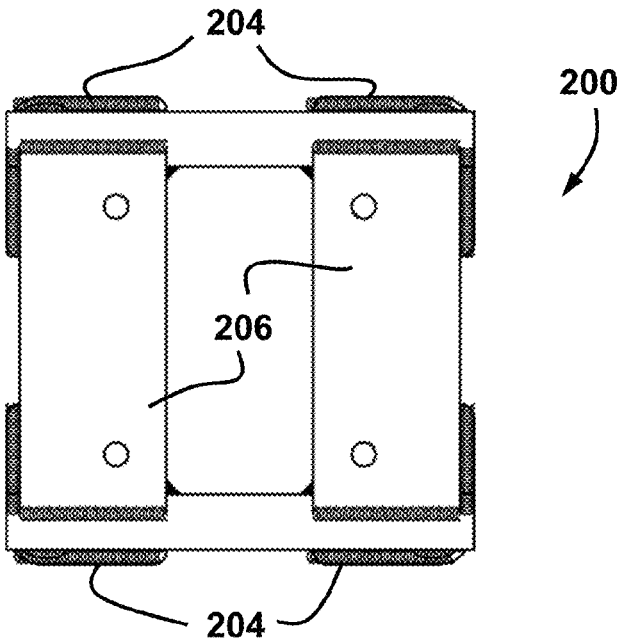
FIGS. 10, 11 and 12 are top, front and right side views, respectively, of the junction block connector shown in FIG. 9.
Figure 11:
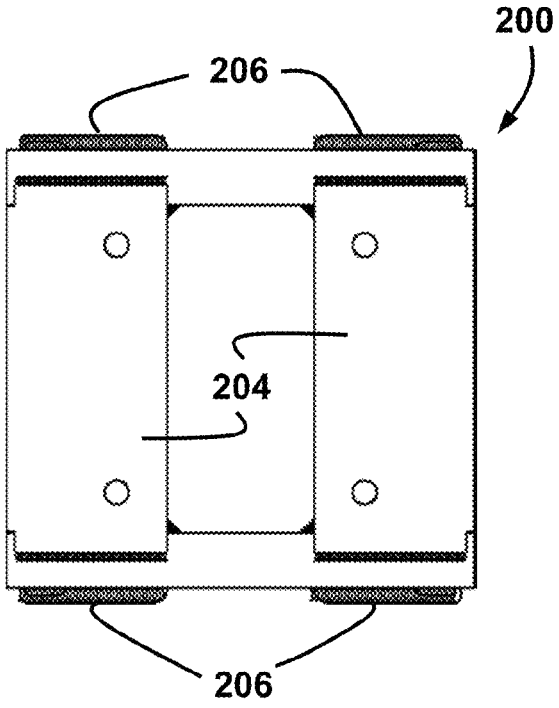
Figure 12:
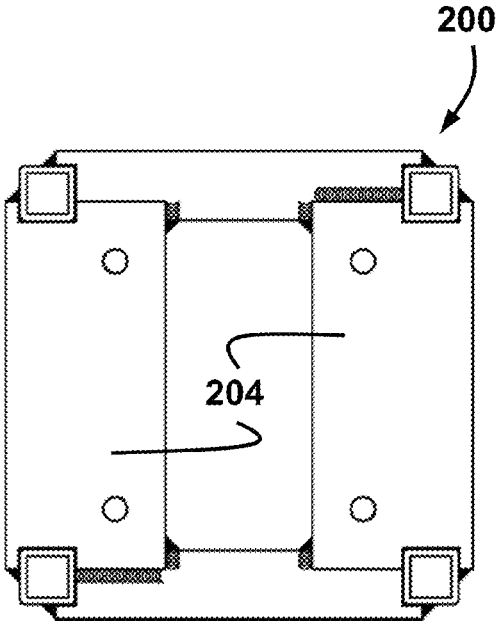

FIG. 8 is an isometric view illustrating an example of a plurality of adjacent structural trusses 100 being connected to one another through a junction block connector 200. The junction block connector 200 provides the interface between the adjacent ends of these structural trusses 100. FIGS. 10, 11 and 12 are top, front and right side views, respectively, of the junction block connector 200 shown in FIG. 9.

The junction block connector 200 includes a small square-shaped framework 202 formed by four spaced-apart tubes to which a number of connector plate members 204, 206 are welded. In the illustrated example, the first connector plate members 204 are disposed vertically and are double sided. The second connector plate members 206 are disposed horizontally, namely at the top and bottom sides, and are similar to the connector plate members 120. Such arrangement provides a very resistant construction that is easier to manufacture compared to an arrangement made of tubes welded at right angle.

Figure 9:
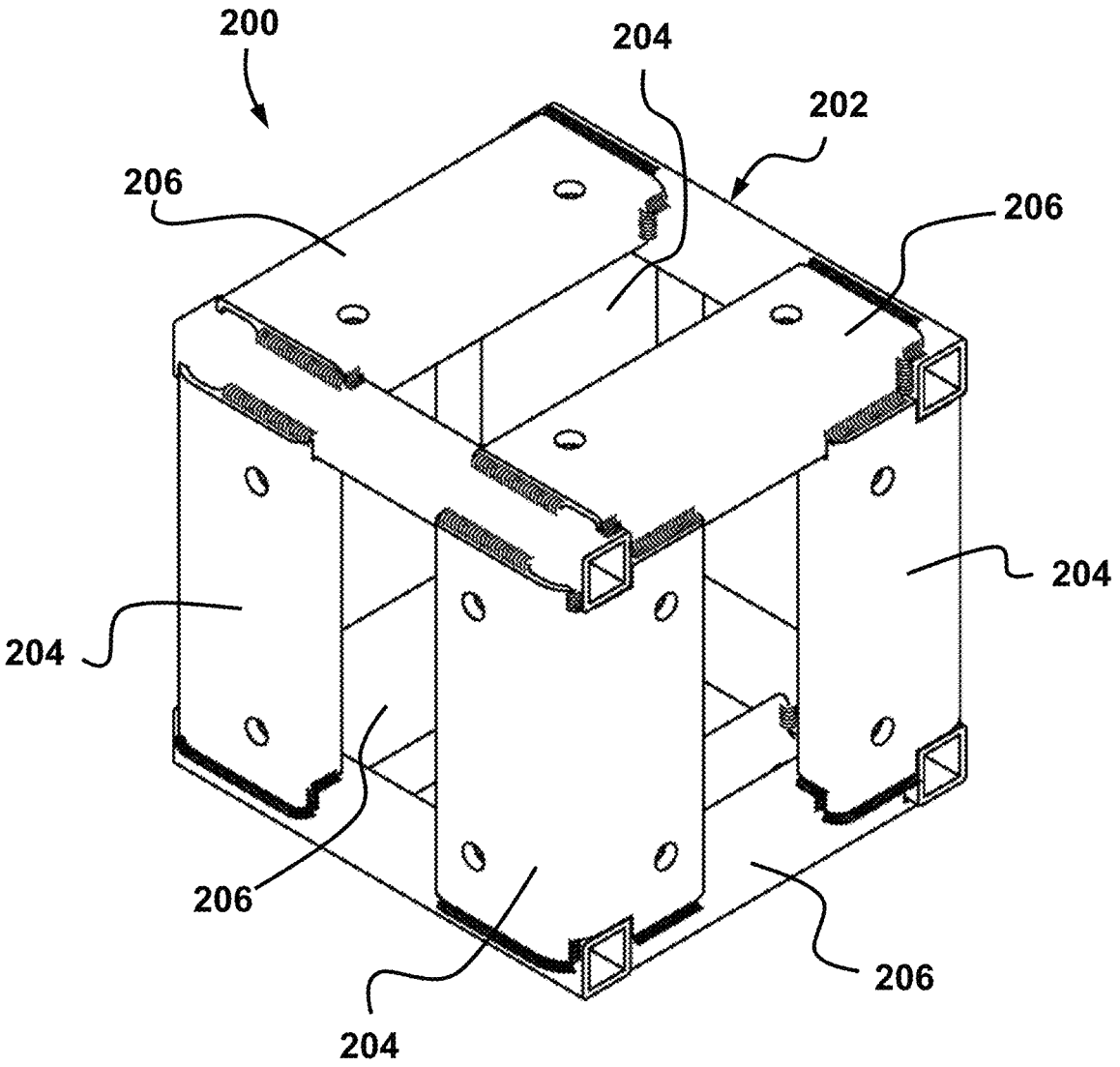
FIG. 9 is an enlarged isometric view of the junction block connector of FIG. 8.
Figure 13:
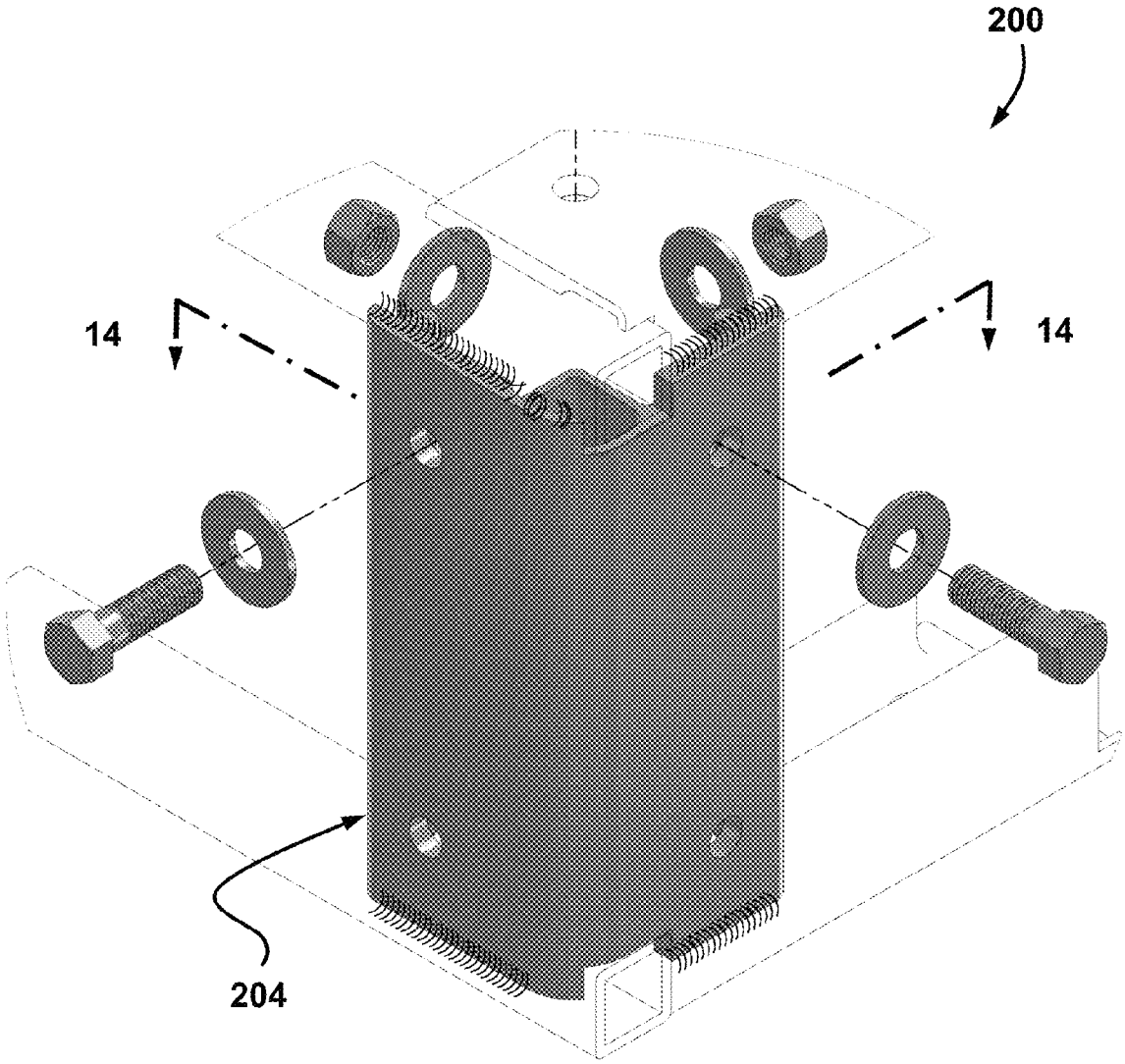
FIG. 13 is an enlarged isometric and semi-schematic view of one of the double-sided connector plate members on the junction block connector shown in FIG. 9.

FIG. 13 is an enlarged isometric and semi-schematic view of one of the double-sided connector plate members 204 on the junction block connector 200 shown in FIG. 9.

Figure 14:
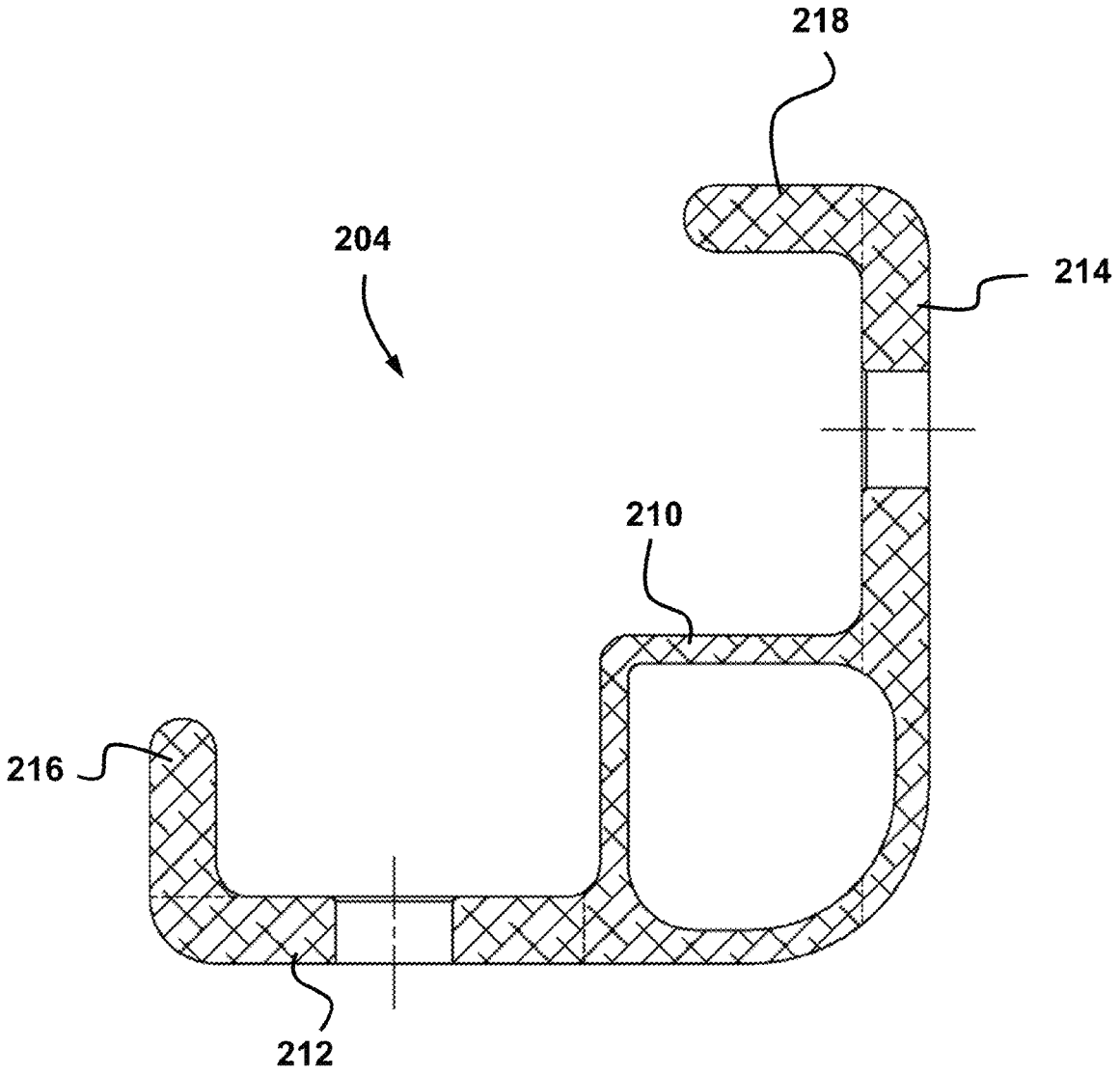
FIG. 14 is a cross section view of the double-sided connector plate member taken along line 14-14 in FIG. 13.

FIG. 14 is a cross section view of the double-sided connector plate member 204 taken along line 14-14 in FIG. 13. This connector plate member 204 includes a corner beam member 210 and two main plate sections 212, 214, each projecting from a respective side of the corner beam member 210. The two main plate sections 212, 214 are disposed at right angle from one another. They each include a corresponding lip 216, 218.

Figure 15:
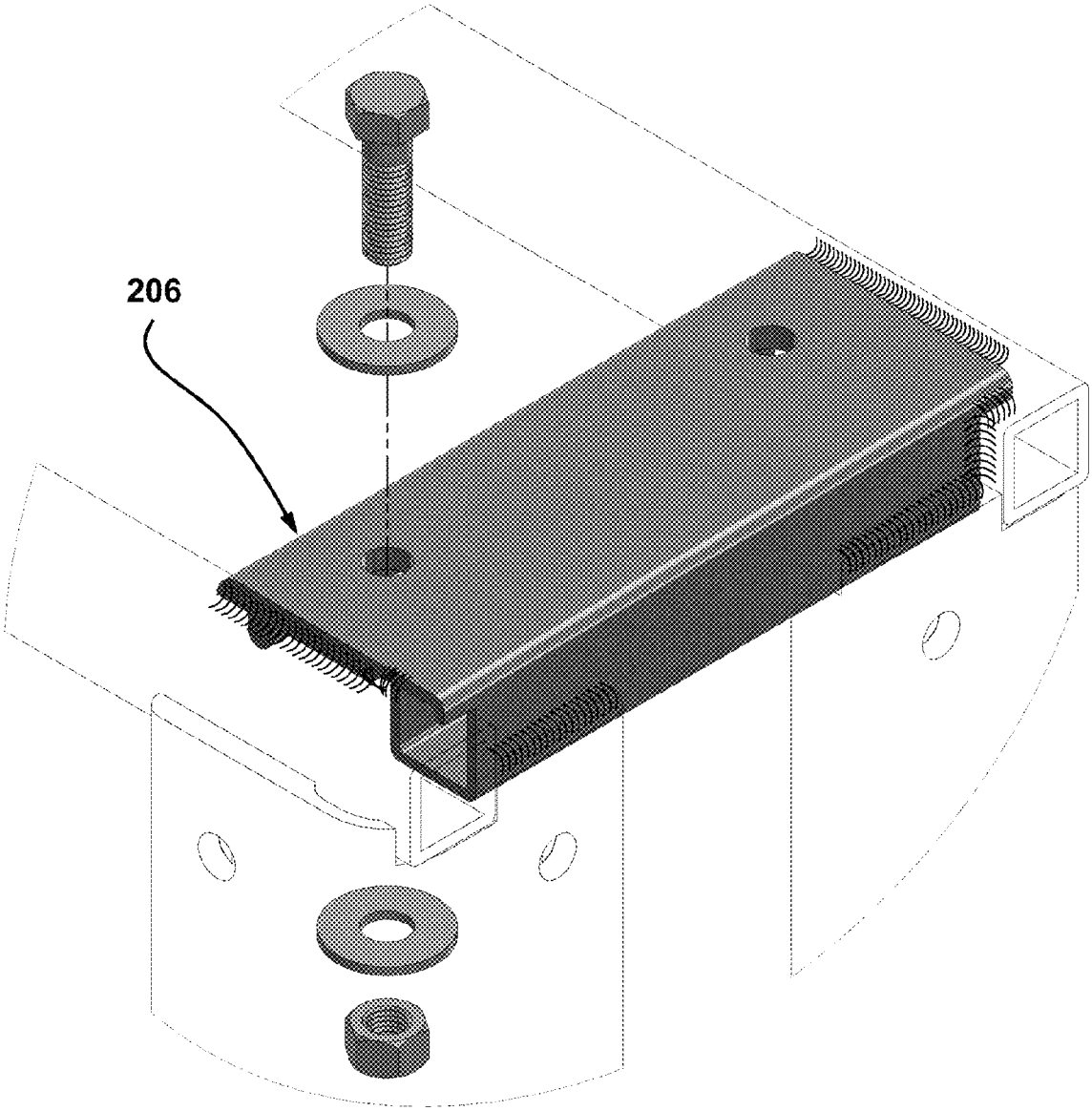
FIG. 15 is an enlarged isometric view of one of the second connector plate members on the junction block connector shown in FIG. 9.

FIG. 15 is an enlarged isometric view of one of the second connector plate members 206 on the junction block connector 200 shown in FIG. 9.

Figure 16:
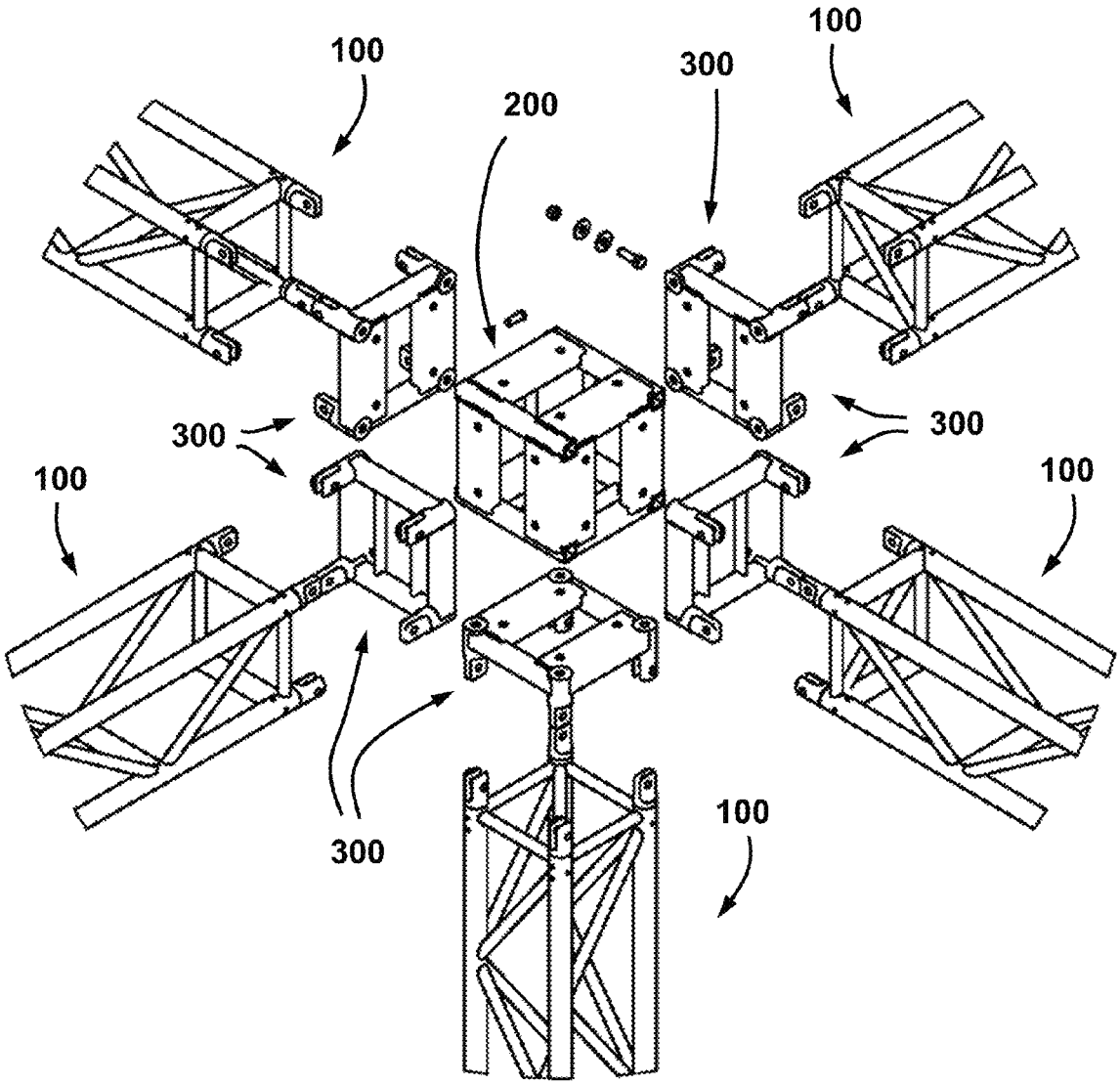
FIG. 16 is an isometric view illustrating another example of a plurality of adjacent structural trusses with framework extensions being connected to one another through a junction block connector.

FIG. 16 is an isometric view illustrating another example of a plurality of adjacent structural trusses 100 with framework extensions 300 being connected to one another using the junction block connector 200. As can be seen, the ends of the structural trusses 100 in FIG. 16 are removably attached to the rest of their framework 102. These framework extensions 300 can quickly adapt one model of structural truss 100 to the interface of the junction block connector 200. Once connected to the structural trusses 100, they form a part thereof.

Figure 17:
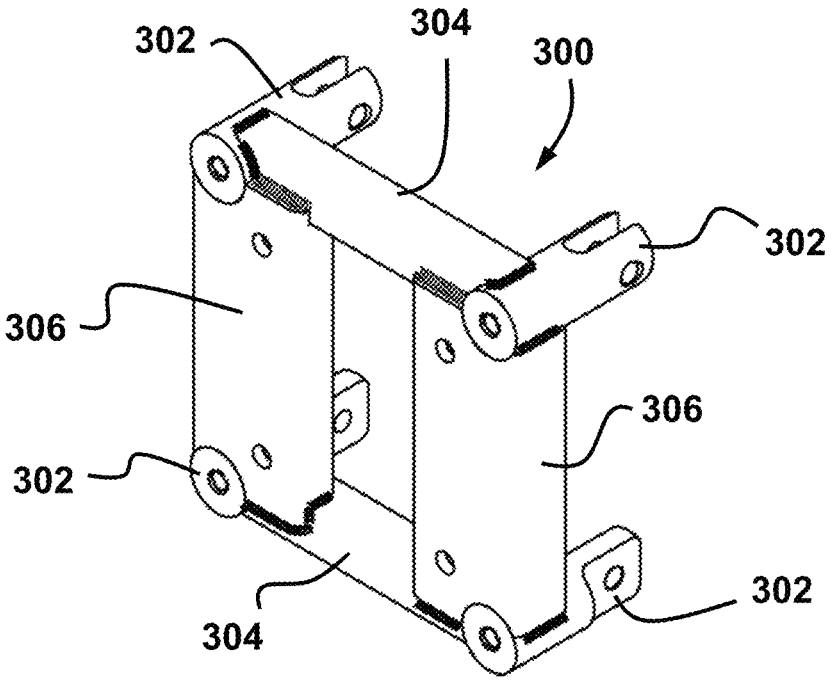
FIG. 17 is an isometric view of one of the framework extensions shown in FIG. 16.

FIG. 17 is an isometric view of one of the framework extensions 300 shown in FIG. 16. The framework extension 300 includes four spaced-apart spigots 302 to which are connected two transversal members 304 and two connector plate members 306. These connector plate members 306 are similar in construction to the connector plate members 120.

Each spigot 302 is configured and disposed to fit over the tip of a corresponding one of the longitudinal tubes 106. In the illustrated example, the tips of the longitudinal tubes 106 have male and/or female connectors and the framework extensions 300 have corresponding opposite connectors. The exact configuration can vary from one implementation to another.

Figure 18:
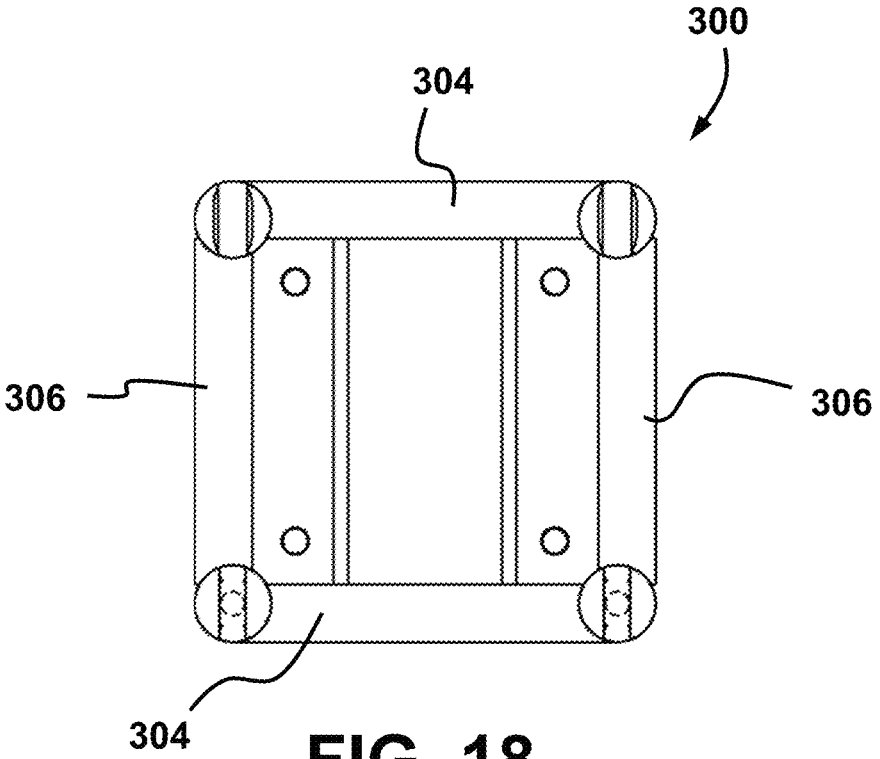
FIG. 18 is a rear view of the framework extension shown in FIG. 17.
Figure 19:
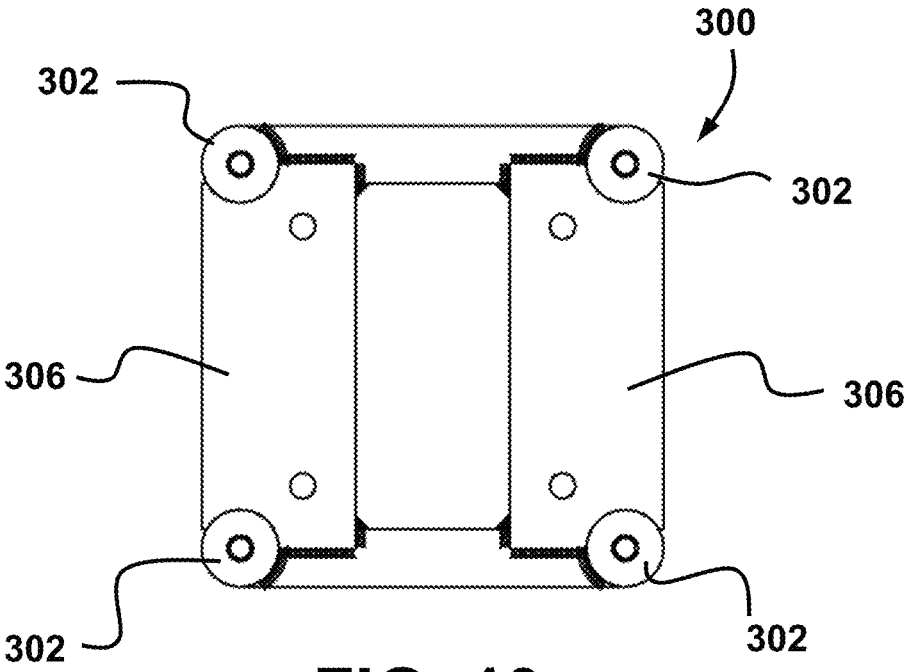
FIG. 19 is a front view of the framework extension shown in FIG. 17.
Figure 20:
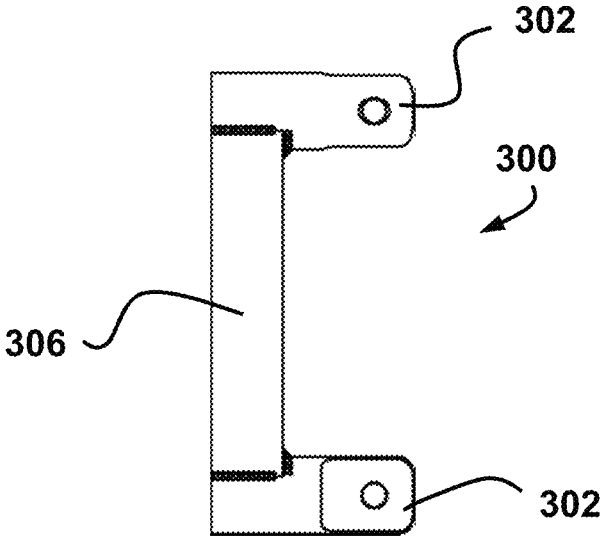
FIG. 20 is a side view of the framework extension shown in FIG. 17.

FIG. 18 is a rear view of the framework extension 300 shown in FIG. 17. FIG. 19 is a front view of the framework extension 300 shown in FIG. 17. FIG. 20 is a side view of the framework extension 300 shown in FIG. 17.

Figure 21:
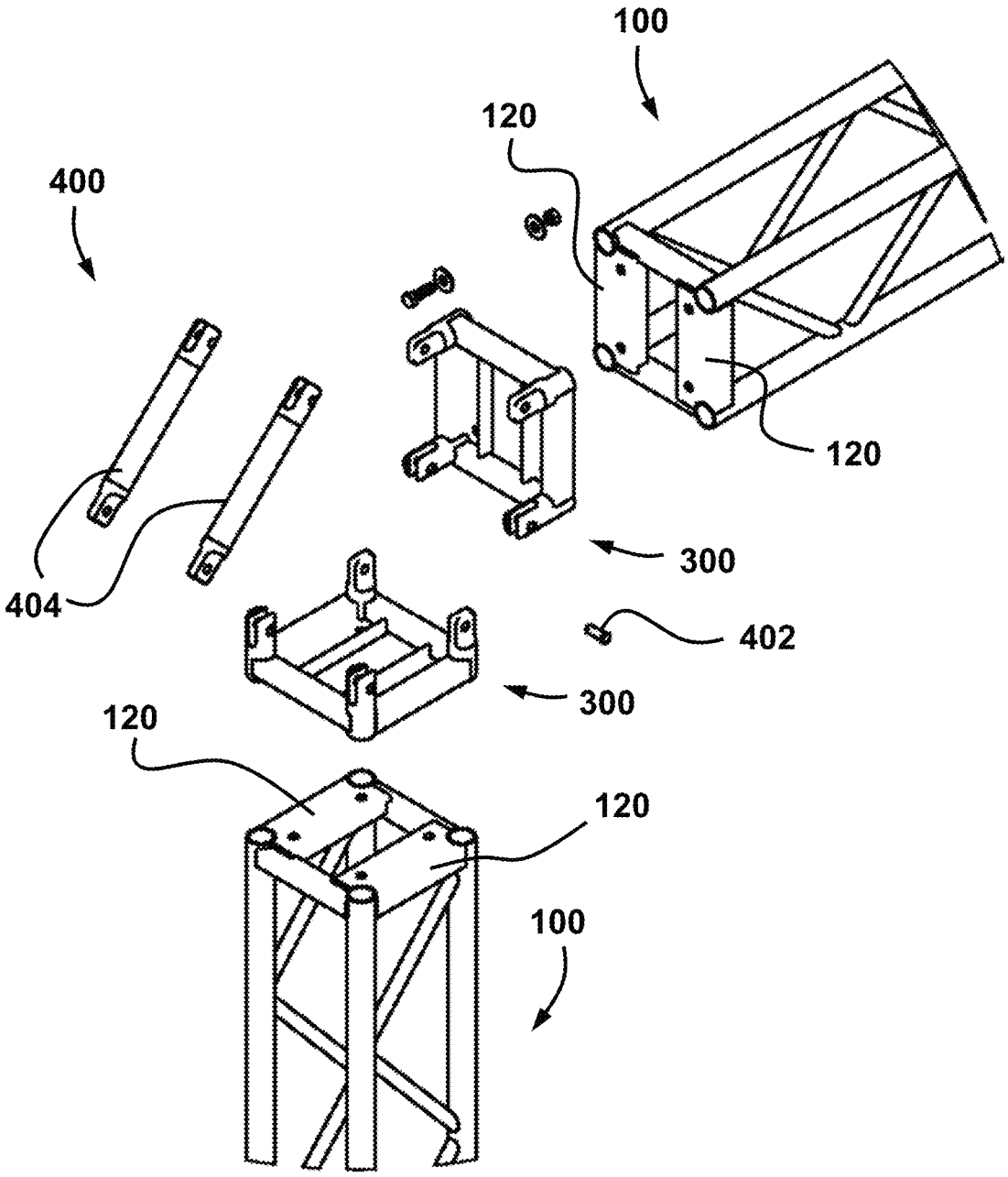
FIG. 21 is an isometric view illustrating an example of two adjacent and perpendicular structural trusses being connected end-to-end through an adaptor unit.
Figure 22:
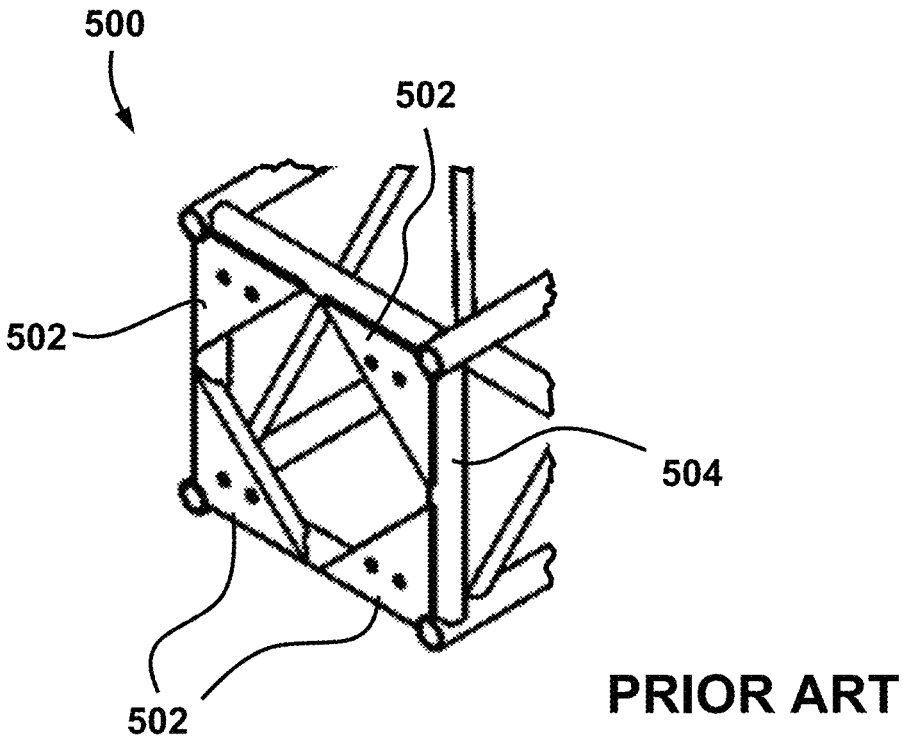
FIG. 22 is an example of end plates welded to the end portion of a structural truss as found in the prior art.

FIG. 21 is an isometric view illustrating an example of two adjacent and perpendicular structural trusses 100 being connected end-to-end through an adaptor unit 400. The adaptor unit 400 is made of two framework extensions 300 disposed at right angle from one another. They are directly connected together at a mating side using pins 402 or the like. The other spigots are connected using two obliquely-disposed linking rods 404.

The present detailed description and the appended figures are meant to be exemplary only, and a skilled person will recognize that many changes can be made while still remaining within the proposed concept.

What is claimed is:

1. A quadrilateral structural truss having a tubular framework with opposing ends and that extends lengthwise along a main longitudinal axis, at least one of the opposing ends of the framework including two connector plate members welded to the framework between two corresponding longitudinal tubes, the two connector plate members being disposed in parallel and opposite to one another, each connector plate member being made of a monolithic piece having an outer side and a rear side, each connector plate member including:

a corner beam section extending between the two corresponding longitudinal tubes, the corner beam section protruding from the rear side of the connector plate member, the corner beam section including two opposite ends, each having a corresponding first cutout configured and disposed to fit around an end of the corresponding longitudinal tubes;

a main plate section extending perpendicularly inwards on a side of the corner beam section and in a direction that is substantially perpendicular to the longitudinal axis, the main plate section including at least one fastener hole to receive a mounting bolt, the main plate section and the corner beam section defining together a planar outer abutment plate surface; and a lip projecting at right angle from the main plate section on the rear side of the connector plate member, the lip extending substantially parallel to the corner beam section.

2. The structural truss as defined in claim 1, wherein the lip includes two opposite ends, each having a corresponding second cutout.

3. The structural truss as defined in claim 1, wherein the corner beam section includes a hollow tubular section.

4. The structural truss as defined in claim 1, wherein the lip is located along the edge of the main plate section that is away from the corner beam section.

5. The structural truss as defined in claim 1, wherein the framework of the structural truss includes a removable framework extension at one of the opposing ends, the two connector plate members being provided on the framework extension of the framework.

* * * * *